United States Patent [19]

Zacky et al.

[11] Patent Number: 4,657,319

[45] Date of Patent: Apr. 14, 1987

[54] EXTRUDED NOSING FOR A FURNITURE PEDESTAL OR THE LIKE

[75] Inventors: Ralf G. Zacky, Los Angeles; Gordon L. Alexander, Sylmar, both of Calif.

[73] Assignee: Aspects, Inc., Redlands, Calif.

[21] Appl. No.: 724,562

[22] Filed: Apr. 18, 1985

[51] Int. Cl.[4] ..... A47B 88/00

[52] U.S. Cl. ..... 312/333; 312/348

[58] Field of Search ..... 312/330, 224, 296, 333, 312/348; 49/485

[56] References Cited

U.S. PATENT DOCUMENTS 2,647,792 8/1953 Flemming ..... 49/485

3,680,941 8/1972 Shanks ..... 312/330 R

*Primary Examiner*—Kenneth J. Dorner

*Assistant Examiner*—Joseph Falk

*Attorney, Agent, or Firm*—Charles H. Schwartz; Ellsworth R. Roston

[57] ABSTRACT

A nosing for a furniture pedestal or the like wherein the pedestal includes sidewalls forming an interior space between the sidewalls and with at least one closure member extending across the sidewalls of a front edge position to at least partially enclose the interior space and with the nosing extending along the front edge of at least one of the sidewalls. The nosing including a main portion for overlaying and covering the front edge of the sidewall and a front extending portion extending angularly from one side of the main portion toward the back of the closure member for acting as a stop for the closure member and for spacing the back of the closure member from the main portion of the nosing. The space formed between the back of the closure member and the main portion of the nosing forming a finger recess for allowing the closure member to be pulled forward to expose the interior of the pedestal.

14 Claims, 6 Drawing Figures

FIG. 1
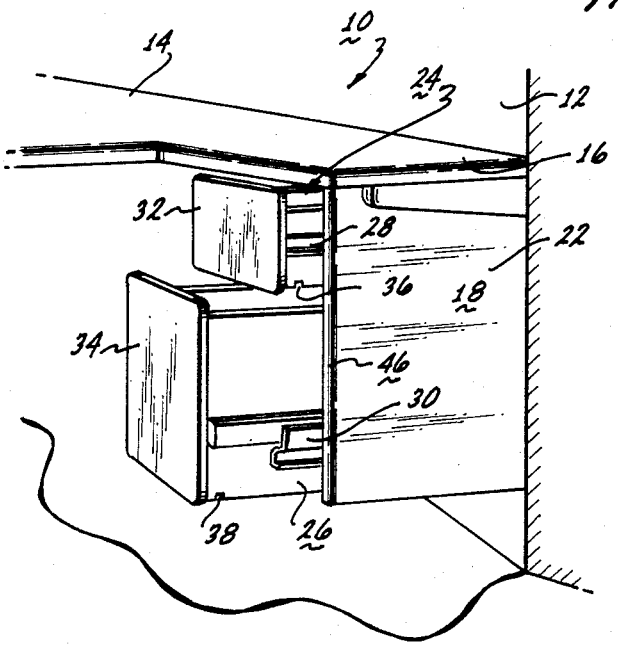
FIG. 3
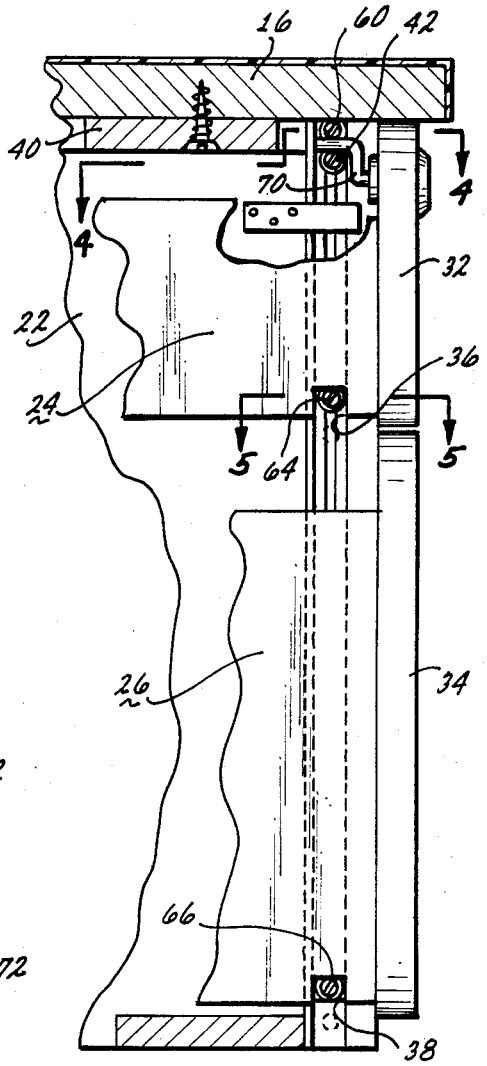
FIG. 4
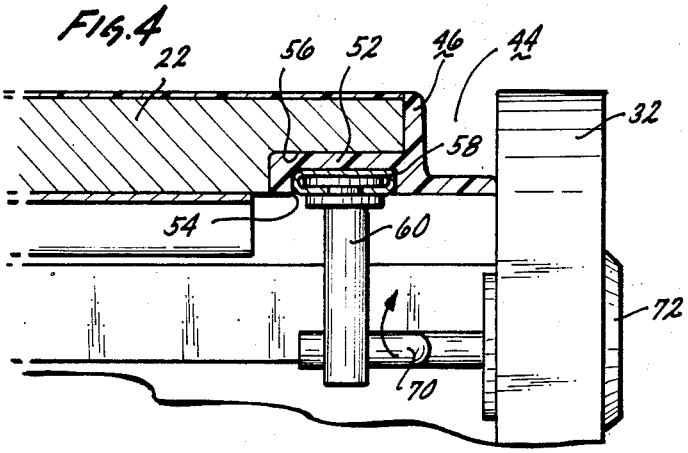
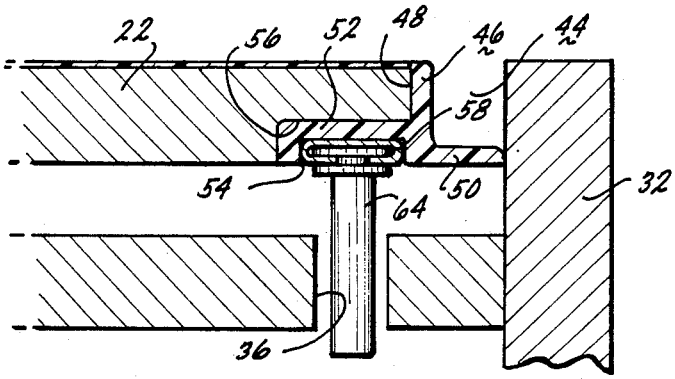
FIG. 5

16
22
52
46
44
54
60
62
68
40
70
72
74
64
20
24
58
46
44
32
26
18
34
38
66

52
48
46
54
58
50
66
42
57

EXTRUDED NOSING FOR A FURNITURE PEDESTAL OR THE LIKE

BACKGROUND OF THE INVENTION

1. Field of the Invention

The present invention relates to an extruded nosing for a furniture pedestal or the like. In particular, the present invention provides for a nosing for finishing off the front edge of the side walls of the pedestal and for providing a finger recess portion to enable the drawers of the pedestal to be opened.

2. Description of the Prior Art

Office furniture is currently being constructed in a modulator form so that desks and work stations may be formed from pre-packaged components. These desks and work stations often use a pedestal having one, two or three drawers of various configurations. These pedestals may be hung from the desk or work station, may extend to the floor to form a partial support for the desk or work station or may even be free-standing, either in a fixed position or mounted on wheels or casters for movement.

One current type of structure for such a pedestal eliminates the need for handles to open the drawers or doors to the interior of the pedestal. In particular, this type of structure incorporates side walls for the pedestal having a relieved front portion to form a finger recess. This allows the fingers of the user of the pedestal to be positioned behind the drawer front so as to pull the drawer or door forward.

The current practice is to use a composite board for the side wall of the pedestal and with the front edge of the composite board routed away so as to provide for the finger recess portion. The composite board is relatively dense in structure and is therefore expensive in cost. However, because of the density of the composite board, the board can be directly painted after routing so as to produce a proper finish for the routed portion of the board. Unfortunately, in addition to the high cost of the composite board, the painted finger recessed portion is vulnerable to dirt and chips and can become unsightly.

SUMMARY OF THE INVENTION

The present invention overcomes the deficiencies with the above-described pedestal structure using an intergral routed finger recess. The present invention replaces this routed finger recess with an extruded pedestal nosing. The extruded nosing provides for the proper finger recess and, in addition, the nosing of the present invention may be extruded from a plastic material matching the color of the remaining portion of the pedestal. The extruded plastic nosing may therefore be easily cleaned and is more resistant to any chipping or damage than the prior art painted surfaces.

In addition to the extruded pedestal nosing of the present invention providing the finger recess, the pedestal nosing may also be formed to accomplish other important structural functions for the pedestal structure. Specifically, an internal side portion of the pedestal nosing may be formed with an integral groove so as to receive and support a portion of a locking structure for the drawers of the pedestal. The current practice is to have a lock located on the side wall of the pedestal and it is sometimes difficult to lock and unlock the drawers from this position. The present position provides for a front mounting of the lock mechanism to actuate the locking structure located in the integral groove in the pedestal nosing.

A further improvement in the pedestal nosing of the present invention is the additional use of the integral groove to provide for the reception and support of a front rail extending between the two side walls of the pedestal. This front rail may be used for added support, especially if the pedestal is to be free-standing.

A BRIEF DESCRIPTION OF THE DRAWINGS

A clearer understanding of the present invention will be had with reference to the following description and drawings wherein:

FIG. 1 is a perspective view of a pedestal mounted in a work station and incorporating an extruded pedestal nosing of the present invention;

FIG. 3 is a side cross-sectional view illustrating the locking structure in a locked position;

FIG. 4 is a top cross-sectional view taken along lines 4—4 of FIG. 3;

FIG. 5 is a top cross-sectional view taken along lines 5—5 of FIG. 3.

DESCRIPTION OF THE PREFERRED EMBODIMENT

Figures 2, 6:
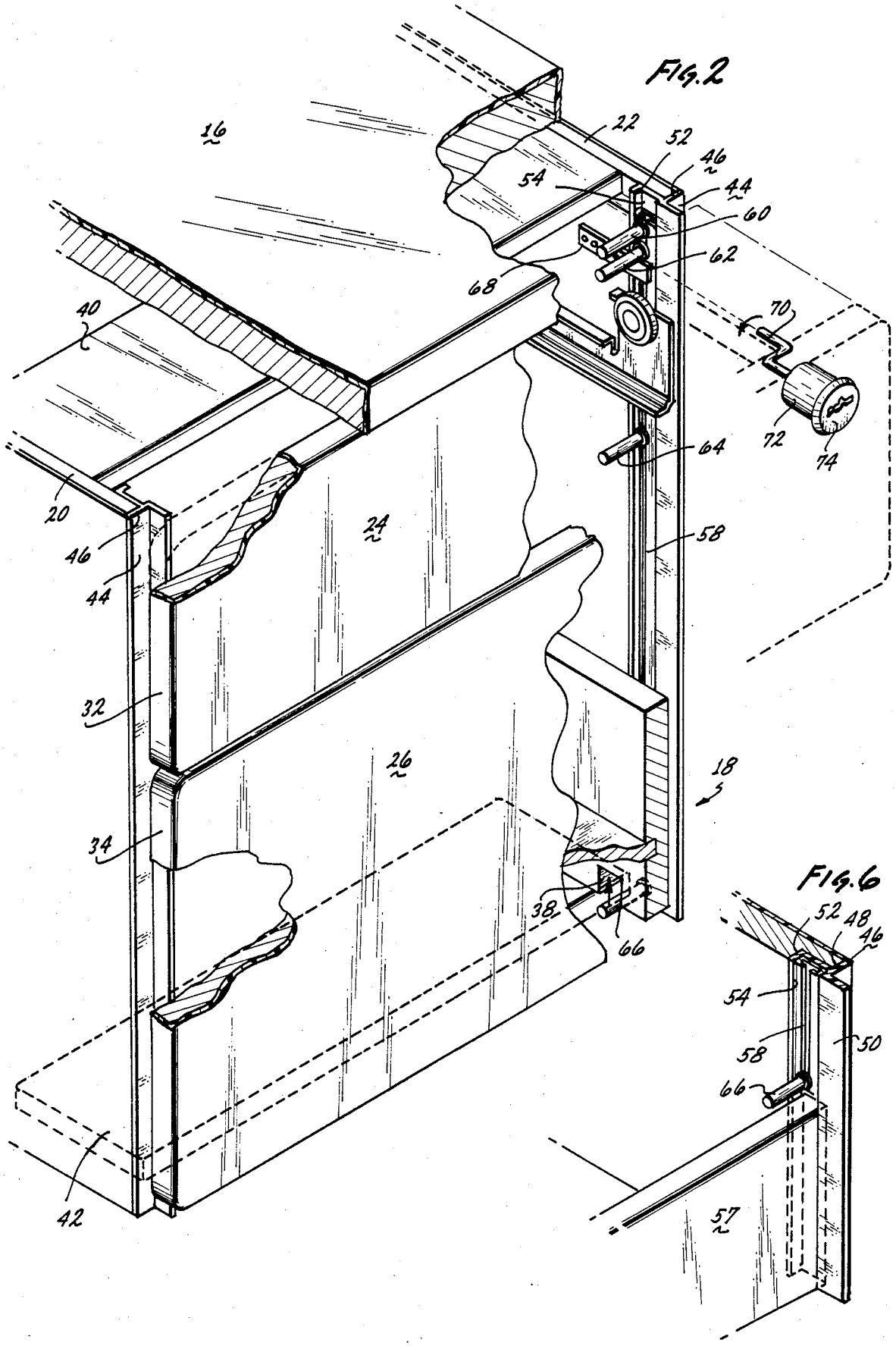
FIG. 2 is a detailed, partially-broken away perspective view illustrating the nosing of the present invention and incorporating the integral lock structure.
FIG. 6 is a detailed view illustrating the nosing incorporating a front rail.

FIG. 1 illustrates a pedestal incorporating an extruded molding in accordance with the teachings of the present invention. Specifically, a work station 10 may include a back wall 12 and a work top 14 having an extention 16 located above a pedestal 18. The pedestal 18 is shown in more detail in FIG. 2 and includes a side walls 20 and 22 and drawers 24 and 26. The drawers may be formed of standard drawer construction and, as shown in FIG. 1, the drawers are supported by sliding roller-bearing structures 28 and 30 to allow the drawers to the opened and closed. The drawer 24 includes a drawer front 32 and the drawer 26 includes a drawer front 24. In addition, each drawer includes a locking slot and specifically drawer 24 includes locking slot 36 and drawer 26 includes locking slot 38.

In addition to the side walls 20 and 22, the pedestal 18 includes at least one top rail 40 and at least one bottom rail 42 extending between the side walls to form a rigid box-like structure to support the drawers 24 and 26. Typically, two top rails and two bottom rails are used and with the pedestal attached to the worktop portion 16 by screw members (as shown in FIG. 3) passing through the top rails 40 and into the work portion 16. In order to open and close the drawers 24 and 26, a finger recess area 44 is provided behind both sides of the door fronts 24 and 26. In particular, nosing 46, constructed in accordance with the teachings of the present invention is positioned adjacent the front edges of the side walls 20 and 22 to provide for the finger recess 44. The same nosing is used for both side walls by merely providing the proper orientation for the nosing. The nosing 46 may be formed of plastic or metal but plastic is preferred. Also, the nosing may be extruded so that long lengths of nosing are produced and then cut into the desired length.

The extruded pedestal nosing 46 has a right angle configuration so as to have a first portion 48 serve as a front face for the front edge of the side walls 20 and 22. Also the closing 46 has a second portion 50 which extends forward to contact the back of the drawer front and provide the proper spacing to produce the finger recess 44. In addition, the nosing includes a backwardly extending internal portion 52 forming including an elongated groove 54. The groove serves to receive a locking structure and/or receives a front rail such as a front rail 57 shown in FIG. 6.

In order to accomodate the backwardly extending portion 52, the side walls 20 and 22 of the pedestal may be routed out, such as shown in FIGS. 4 and 5 at position 56. The top and bottom surfaces of the side walls 20 and 22 may also be routed out to receive the top rails 40 and 42. It is to be appreciated that the pedestal nosing 46 may be attached directly to the side walls 20 and 22 without the routed out portion 54 as long as the width of the nosing is sufficient to cover the entire front edge of the side walls 20 and 22. The nosing may be attached to the side walls using fastening means such as staples or the nosing may be attached by other means including adhesive or screws.

The locking structure includes an elongated member 58 having a dimension to fit within and slide in the groove 54 in the portion 52 of the nosing 46. The member 58 may be formed by folding over a long piece of flat metallic material so that a plurality of pins may be positioned at various locations along the member 58. As shown in FIG. 2, two pins 60 and 62 may be positioned at an upper position in the member 58, a pin 64 may be positioned at an intermediate position and a pin 66 maybe positioned at the bottom of the member 58. The pins 64 and 66 cooperate with the slots 36 and 38 in the sides of the drawers 24 and 26 so as to provide for a locking of these two drawers.

A stop member 68 is attached to the inside surface of the side wall 22 to act as a stop to limit the downward motion of the elongated member 58. As can be seen, the pin 62 actually rests on the member 68 to limit the downward motion. An offset locking actuator 70 extends to a position between the pins 60 and 62 when the drawer 24 is closed. The offset locking actuating 70 is part of a lock mechanism 72 which is mounted in the upper right hand corner of the drawer 24. The lock mechanism may be of any type and is shown to be a key lock which requires the insertion of a key in the opening 74 to actuate the locking actuator 70. Specifically, the insertion of the proper key allows for the rotation of an internal cylinder which in turns rotates the offset, locking actuator 70 between a locked and an unlocked position.

As shown in FIG. 2, the locking mechanism is in the unlocked position to have the locking actuator 70 rotated clockwise so that the elongated member 58 is in its downward position and with the pins 54 and 56 disengaged from the slots 36 and 38. In this unlocked position, the drawers may be freely opened and closed since there is no interference between the pins 64 and 66 and the slots 36 and 38. When the drawer 24 is opened in the unlocked position, the locking actuator 70 slides out from between the pins 60 and 62. When the drawer 24 is closed, the locking actuator 70 enters into the space between the pins 60 and 62.

If the key is inserted and the locking mechanism rotated counterclock-wise, the offset locking actuator 70 raises the elongated member 58 since the offset portion of the locking actuator pushes against the pin 60 to move the pin and the entire member 58 to an upward locked position. This locked position is shown in FIG. 3. In the locked position, the pins 64 and 66 enter into the slots 36 and 38 and thereby prevent the drawers 24 and 26 from being opened.

The invention has been described with reference to a 2-drawer hanging pedestal but it is to be appreciated that any number of drawers may be used for the pedestal. In addition, the pedestal, instead of hanging, may extend down to the floor so that the pedestal serves as a support for the work surfaces or so that the pedestal is free standing and even moveable relative to the work surface. In such a structure, it may be desirable to include a front rail extending between the side walls 20 and 22 to give additional support to the pedestal structure. As shown in FIG. 6, the front rail 57 may extend into and be locked by the groove 54 formed in the nosing 46. The groove in the nosing 46 may therefore serve an additional function of retaining a front rail and thereby eliminate the necessity of providing additional structure to support this front rail.

It is also to be appreciated that the invention has been described showing sliding drawers but that other types of structures may be incorporated such as hinged doors or pull up or pull down doors.

Although the invention has has been described with reference to a particular embodiment, various adaptations and modifications may be made and the invention is only to be limited by the appended claims.

We claim:

1. A nosing for a furniture pedestal or the like wherein the pedestal includes sidewalls forming an interior space between the sidewalls and with at least one closure member extending across the sidewalls of a front edge position to at least partially enclose the interior space and with the nosing extending along the front edge of at least one of the sidewalls, the nosing including a main portion for overlaying and covering the front edge of the sidewall, a front extending portion extending angularly from one side of the main portion toward the back of the closure member for acting as a stop for the closure member and for spacing the back of the closure member from the main portion of the nosing a particular distance, the particular distance of the space formed between the back of the closure member and the main portion of the nosing being sufficient to form a finger recess for allowing the closure member to be pulled forward to expose the interior of the pedestal, a back extending portion extending at a right angle from one side of the main portion and with the back extending portion for attachment to the inside of the sidewall, and the pedestal including a front rail member extending between the sidewalls and wherein the back extending portion includes a groove for receiving and securing the front rail member.

2. The nosing of claim 1 wherein the nosing is formed from an extruded member.

3. The nosing of claim 2 wherein the extruded nosing is formed of plastic.

4. A furniture pedestal including, a pair of side walls forming an interior space there between and having front edges, at least one drawer structure supported within the interior space and extending between the sidewalls, the drawer structure including a drawer front extending across the front edges of the sidewalls to at least partially enclose the interior space, a nosing extending along the front edge of at least one of the sidewalls, the nosing including a main portion for overlaying and covering the front edge of the sidewall, a front extending portion extending from the main portion to the back of the drawer front to act as a stop for the drawer front to space the drawer front from the main portion of the nosing a particular distance so that the particular distance of the space between the back of the drawer front and the main portion of the housing forms a finger-recess to allow the drawer to be pulled forward to expose the interior of the pedestal, a back extending portion extending at a right angle from the one side of the main position and with the back extending portion attached to the inside of the side wall, and the pedestal including a front rail member extending between the sidewalls and wherein the back extending portion includes a groove for receiving and securing the front rail member.

5. The pedestal of claim 4 wherein the nosing is formed from an extruded number.

6. The pedestal of claim 5 wherein the extruded nosing is formed of plastic.

7. A nosing for a furniture pedestal or the like wherein the pedestal includes sidewalls forming an interior space between the sidewalls and with at least one closure member extending across the sidewalls of a front edge position to at least partially enclose the interior space and with the nosing extending along the front edge of at least one of the sidewalls, the nosing including a main portion for overlaying and covering the front edge of the sidewall, a front extending portion extending angularly from one side of the main portion toward the back of the closure member for acting as a stop for the closure member and for spacing the back of the closure member from the main portion of the nosing, the particular distance of the space formed between the back of the closure member and the main portion of the nosing being sufficient to form a finger recess for allowing the closure member to be pulled forward to expose the interior of the pedestal, a back extending portion extending at a right angle from the one side of the main portion and with the back extending portion for attachment to the inside of the sidewall, and the pedestal including a locking actuator extending through a portion of the pedestal and wherein the back extending portion includes a groove and additionally including a sliding lock member received in the groove to interface with the opening of the closure member to provide locking of the closure member in accordance with the actuation of the locking actuator.

8. The nosing of claim 7 wherein the nosing is formed from an extruded member.

9. The nosing of claim 8 wherein the extruded nosing is formed of plastic.

10. The nosing of claim 7 wherein the closure member is the drawer front and with the drawer front including a locking actuator for actuating the sliding lock member received in the groove of the back extending portion.

11. A furniture pedestal including;

a pair of side walls forming an interior space there between and having front edges, at least one drawer structure supported within the interior space and extending between the sidewalls, the drawer structure including a drawer front extending across the front edges of the sidewalls to at least partially enclose the interior space, a nosing extending along the front edge of at least one of the sidewalls, the nosing including a main portion for overlaying the covering the front edge of the sidewall, a front extending portion extending from the main portion to the back of the drawer front to act as a stop for the drawer front to space the drawer front from the main portion of the nosing a particular distance so that the particular distance of the space between the back of the drawer front and the main portion of the nosing forms a finger-recess to allow the drawer to be pulled forward to expose the interior of the pedestal, a back extending portion extending at a right angle from the one side of the main portion and with the back extending portion attached to the inside of the sidewall, and the pedestal including a locking actuator extending through a portion of the pedestal and wherein the back extending portion includes a groove and additionally including a sliding lock member received in the groove to interfere with the opening of the drawer structure to provide locking of the drawer structure in accordance with the actuation of the locking actuator.

12. The pedestal of claim 11 wherein nosing is formed from an extruded member.

13. The pedestal of claim 12 wherein the extruded nosing is formed of plastic.

14. The pedestal of claim 11 wherein the drawer structure includes the locking actuator for actuating the sliding lock member received in the groove of the back extending portion.

* * * * *